US005753212A

United States Patent [19]

Pescatore et al.

[11] Patent Number: 5,753,212

[45] Date of Patent: May 19, 1998

[54] METHOD OF FILLING DISPENSER

[75] Inventors: John E. Pescatore, Andover; William E. Tucker, Attleboro, both of Mass.

[73] Assignee: The Gillette Company, Boston, Mass.

[21] Appl. No.: 714,655

[22] Filed: Sep. 16, 1996

[51] Int. Cl.[6] ..... A61K 7/025; A61K 7/32

[52] U.S. Cl. ..... 424/65; 264/268; 264/279; 401/175; 401/68

[58] Field of Search ..... 264/268, 279; 401/175, 75, 68; 424/65

[56] References Cited

U.S. PATENT DOCUMENTS

| | | | |
|---|---|---|---|
| 3,443,874 | 5/1969 | Pelli et al. | 401/82 |
| 4,369,158 | 1/1983 | Woodruff et al. | 264/268 |
| 4,545,696 | 10/1985 | Carluccio | 401/175 |
| 4,552,161 | 11/1985 | Hill et al. | 132/88.5 |
| 4,664,547 | 5/1987 | Rosenwinkel | 401/175 |
| 4,702,399 | 10/1987 | Davis | 222/390 |
| 4,890,944 | 1/1990 | Cousins et al. | 401/98 |
| 4,915,528 | 4/1990 | Seager | 401/68 |
| 4,932,803 | 6/1990 | Goldberger et al. | 401/75 |
| 4,950,094 | 8/1990 | Yorks | 401/75 |
| 5,137,185 | 8/1992 | Mitchell | 222/390 |
| 5,401,112 | 3/1995 | Dornbusch et al. | 401/68 |

FOREIGN PATENT DOCUMENTS

| | | | |
|---|---|---|---|
| WO 86/06257 | 11/1986 | WIPO | A45D 40/06 |

*Primary Examiner*—Terressa Mosley
*Attorney, Agent, or Firm*—Owen J. Meegan; Aubrey C. Brine; Donal B. Tobin

[57] ABSTRACT

A process for manufacturing a cosmetic product, such as an antiperspirant or deodorant, in stick form includes steps for introducing the product into a container from which the product is dispensed by the user. The product is introduced into the container in molten form and thereafter cooled to produce a substantially solid stick of antiperspirant material. Thereafter, the product is compressed to remove gaseous elements therefrom.

12 Claims, 7 Drawing Sheets

METHOD OF FILLING DISPENSER

BACKGROUND OF THE INVENTION

The present invention relates to the manufacture of cosmetic products and more particularly to a process for the manufacture of a cosmetic product such as an antiperspirant in stick form.

There are many prior art containers of the type in which a product is formed in and dispensed from a container, the product being in the form of a stick which is movable into and out of the container and applied directly from the container held in the hand of the user. Further, such products as deodorants or antiperspirants are often provided in transparent or semitransparent containers wherein the stick of material is observable by the purchaser when displayed at the point of sale. In order to obtain a more efficient applicator which is easier to use and requires fewer strokes, it is preferable that the container for the product be of non-circular, generally oval cross-section configuration and that the upper surface of the stick be of convex contour. It is also highly desirable for aesthetic purposes that the stick material be free of unsightedly voids and completely fill the container when first put into use by the purchaser, or when first used by the purchaser when the container is transparent or semi-transparent.

As many of the materials employed to manufacture a stick material of the type under consideration undergo shrinkage in volume during manufacture, a problem of maintaining a void-free product is of significance. The problem is greatly amplified by the use of an oval or non-circular container wherein the material tends to exhibit an undesirable gap between the walls of the container and the stick containing the material when the material is formed in the dispensing container in the heated state, and then allowed to cool with a resultant shrinkage.

It is, therefore, an object of the present invention to provide a method of manufacturing a product, such as an antiperspirant stick, wherein the product is formed within the container employed for dispensing the same.

A further object of the invention is to provide a process for manufacturing a cosmetic product in stick form wherein the product is introduced into the dispenser container in a molten condition and allowed to cool within the container to its final stick form.

Yet another object of the invention is to provide a process for manufacturing a cosmetic product, such as an antiperspirant in stick form, wherein gaseous elements are removed from the stick material to remove gaps between the material and the inner sides of the container.

SUMMARY OF THE INVENTION

The aforementioned objects and other objectives which will become apparent as the description proceeds are accomplished by providing a process for the manufacture of a cosmetic product, such as an antiperspirant in stick form, which includes the steps of providing a container comprising a tubular body member having an opening at its upper end and an opening at its lower end and a first seal means at one end thereof which contacts the inner surface of the tubular body member in sliding engagement. A predetermined quantity of a cosmetic product at its molten temperature is introduced through the opposite end of the tubular body member and thereafter the cosmetic product is cooled to its non-molten form. A second seal means in disposed in sliding engagement with the opposite end of the tubular member and the product in non-molten form is compressed by fixing one of the seal members and moving the other of the seal members toward the one seal member to force the cosmetic product in non-molten form into contact with the inner surfaces of the tubular member and the seal means by removing gaseous elements from the product.

The second seal means is generally provided with a vent means therein for removing the gases when the product is compressed.

The second seal means may also comprise a platform movable within the tubular body through rotation of a threaded shaft extending axially into the tubular member, in which case the process includes the step of forming an elongated cavity in the product in non-molten form for receiving the threaded shaft, prior to the step of compressing the product.

The elongated cavity may be formed by the threaded shaft or by a separate arbor provided for that purpose as an element in the process.

The molten temperature of the product is generally in the range of 65° C. to 85° C. and the product is cooled to below 40° C. to produce the product in non-molten form prior to the compressing step of the process.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENT

Figure 1:
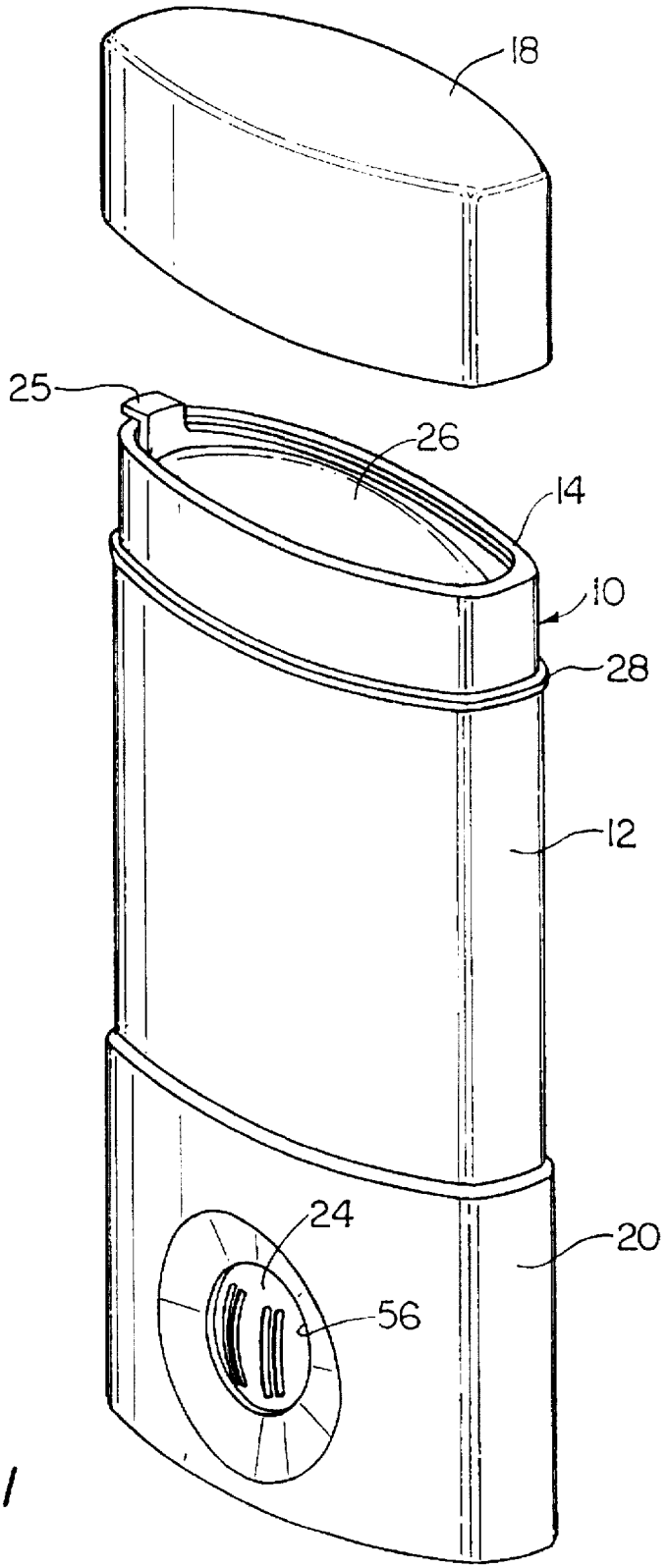
FIG. 1 is an elevational perspective view showing a container for a cosmetic product, such as an antiperspirant in stick form, manufactured in accordance with teachings of the present invention.

Referring now the drawing and in particular to FIGS. 1 through 4 there is shown a container 10 comprising a tubular body member 12 open at the top and bottom and having sealing means in the form of a closure cap 14 at the upper end thereof and a seal member 16 disposed at the bottom thereof. A cover member 18 is provided at the upper end of the member 12 serving to close off the upper end of the tubular body member and to cover the closure cap 14. At the lower end of the container 10, bottom cover 20 engages the lower end of the body member 12 substantially covering the seal member 16.

Figure 2:
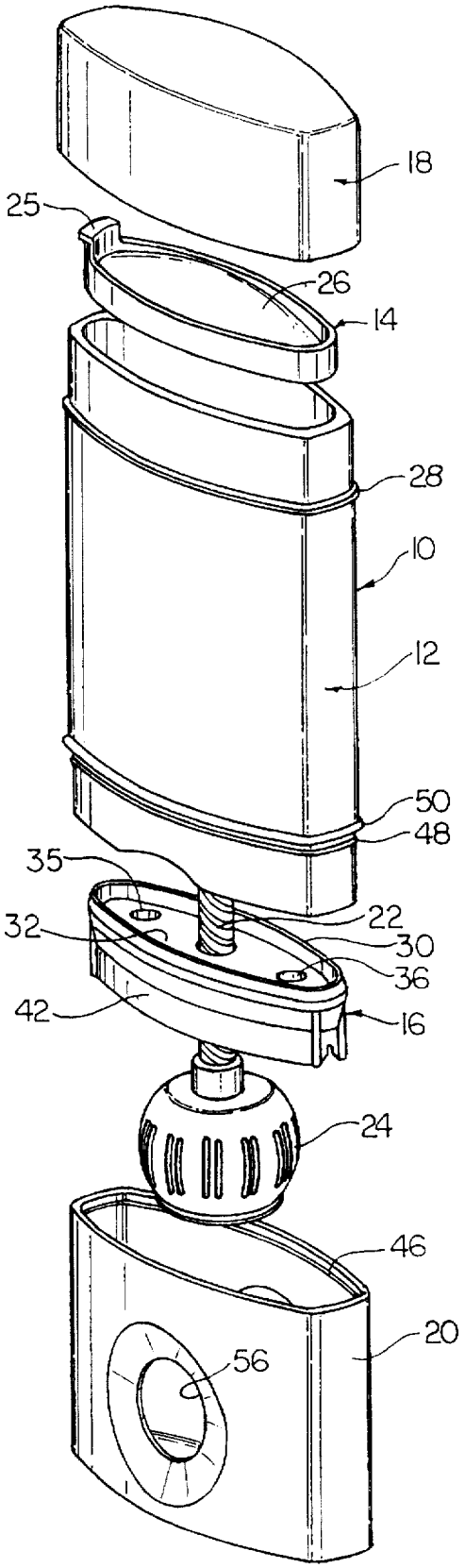
FIG. 2 is an exploded elevational perspective view showing details of the container of FIG. 1.
Figure 3:
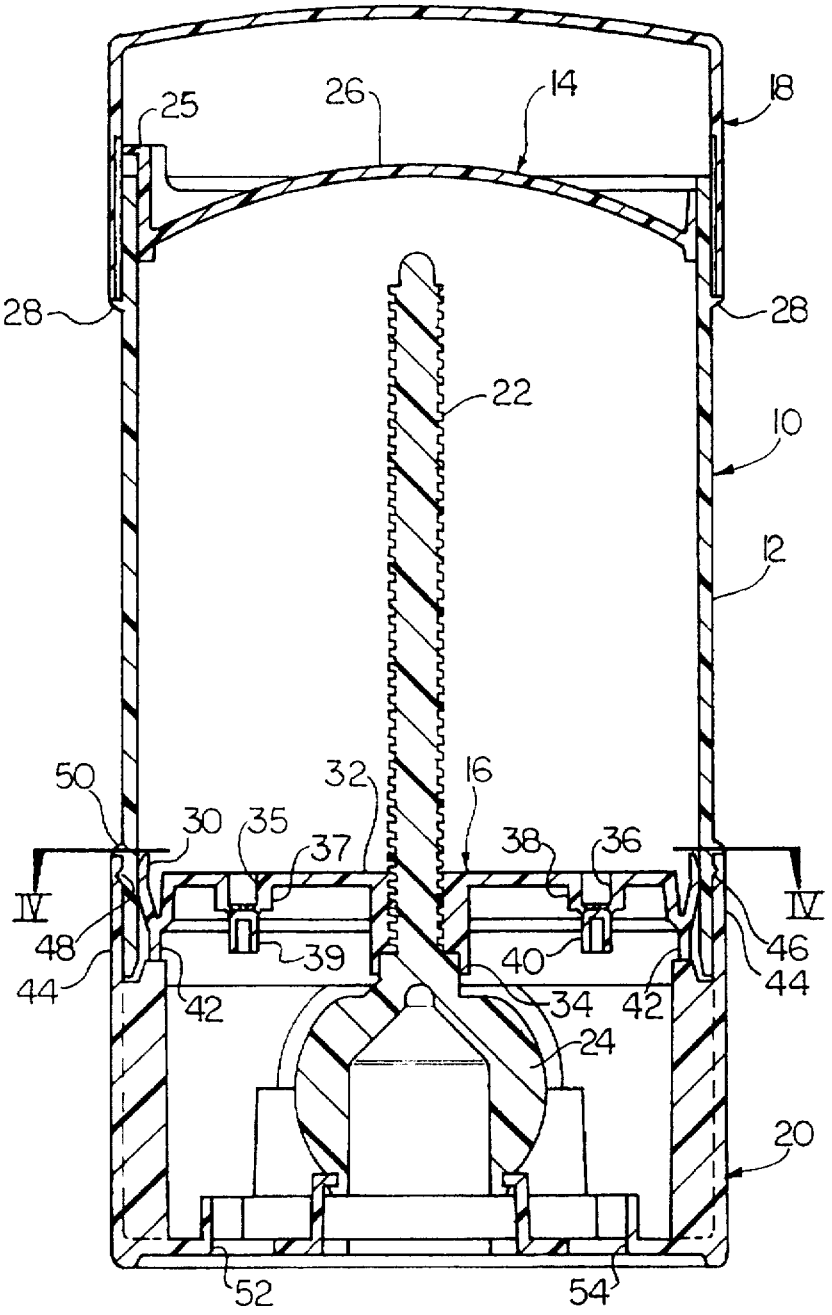
FIG. 3 is a side elevational sectional view taken at the centerline of the container of FIG. 1 and FIG. 2.

As best shown in FIGS. 2 and 3, a shaft 22 is threadedly engaged in a central opening in the seal member 16. The upper end of the threaded shaft 22 extends upwardly into the body member 12 and at its lower end there is disposed a dial member in the form of a ball 24 fixed to the shaft 22.

Figure 4:
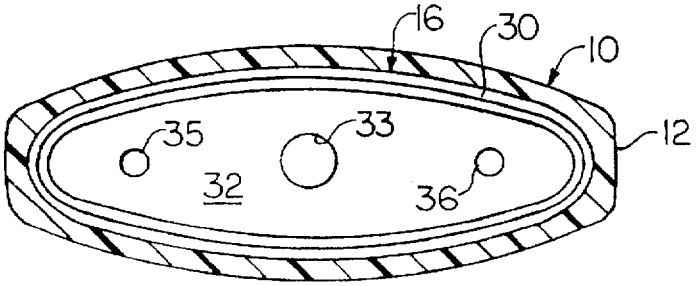
FIG. 4 is a plan sectional view taken along the line IV—IV of FIG. 3.

Referring to FIG. 3 taken in conjunction with FIGS. 1, 2 and 4, the container 10 is shown in the assembled configuration without the product contained therein to show the details of the various elements as assembled.

As will be noted, the closure cap 14 is sealingly engaged at the top inner surface of the body member 12 and slidingly engaged therein to provide for movement of the cap within the body member. A handle 25 is provided at one side of the convex outer surface 26 of the closure cap 14 which handle is intended to be gripped by the user of the container 10 when removing the closure cap 14. An outwardly projecting lip 28 extends around the outer surface of the body member 12 and serves as a stop for the cover member 18 when the cover member is placed over the top of the tubular body member as shown in FIG. 3.

Still referring to FIG. 3, the lower opening of the body member 12 is substantially closed by the seal member 16 which has an upwardly and outwardly biased flange 30 for contacting the inner surface of the body member in interfitting engagement. The seal member 16 further comprises a platform 32 having a central opening 33 which opening extends downwardly through a circular boss 34, the boss inner surface providing threads which engage the threads disposed about the external surface of the shaft 22. A pair of vent openings 35 and 36 are formed in the platform 32 to extend downwardly through bosses 37 and 38, and a pair of plugs 39 and 40 are each retained by a respective thin web onto a respective boss, the web being frangible when the respective plug 39 or 40 is inserted into an opening 35 or 36. A downwardly-projecting flange 42 extends about the periphery of the seal member 16 in spaced relation with the inner surface of the body member 12 and, in the assembled position shown in FIG. 3, contacts the bottom cover 20.

The bottom cover 20 is formed of a shell 44 having an upper periphery which engages the outer periphery of the body member 12 and has a groove 46 disposed about the inner surface thereof which is received onto a V-shaped locking portion 48 which extends outwardly about the outer surface of the body member 12. An outwardly-extending lower lip 50 is disposed about the outer surface of the body member 12 and inhibits upward movement of the bottom cover 20 when the bottom cover is in place. A pair of circular openings 52 and 54 are formed in the bottom surface of the shell 44 substantially in alignment with the plugs 39 and 40 such that a tool may be inserted through the openings to close off the vents 35 and 36 by forcing the plugs 39 and 40 into the vent openings. As will be observed in FIGS. 1 and 2 a pair of side openings 56 in the shell 44 are provided and disposed such that the ball 24 snaps into the openings, the ball being capable of rotation by the user having access through the openings, and being retained in place by the locking engagement between the bottom cover 20 and the body member 12. Thus, as the ball 24 is rotated, it is retained in place and the threaded engagement between the shaft 22 and the seal member 16 is effective to move the seal member 16 and the contents of the container 10 upwardly through the body member 12.

Referring now to FIGS. 5 through 11, there is shown in schematic form the novel method of introducing the cosmetic product into the container 10 during the manufacturing process.

Figure 5:
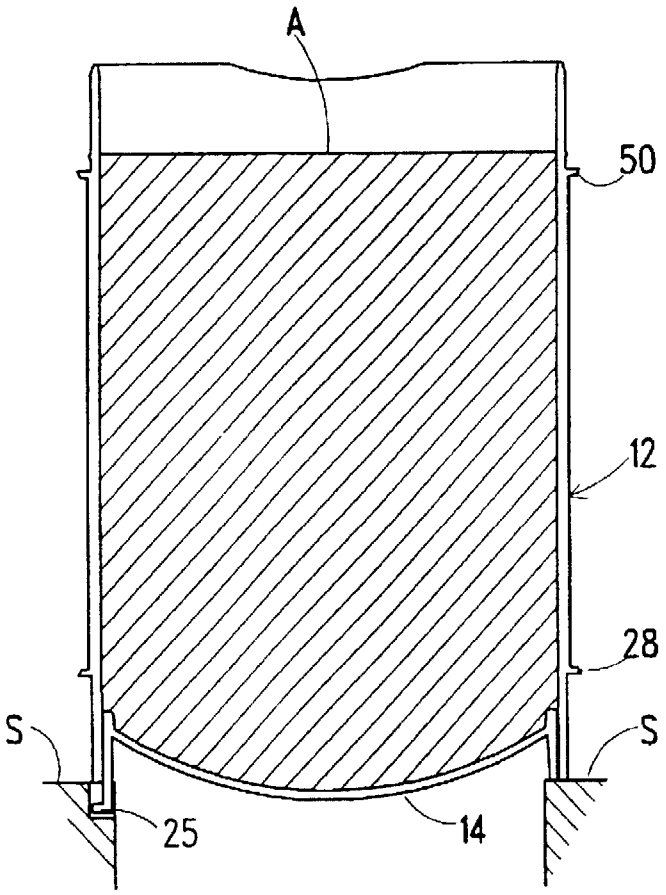
FIG. 5 through FIG. 11 are side elevational sectional views similar to FIG. 3 showing portions of the structure of FIG. 3 during steps of the manufacturing process.

With the tubular body member 12 in its inverted position as shown in FIG. 5, the closure cap 14 is placed into the upward opening of the body member and the upwardly-facing edges (now downwardly-facing) are supported by support structure S. The cosmetic product A, which is an antiperspirant or deodorant, is introduced into the body member 12 in its molten form, which in the present product is at a temperature in the area of 65° C. to 85° C. The product A is then cooled to its non-molten condition, which occurs in the area of 40° C. or lower, at which condition the product has a tendency to shrink and pull away from the inner surface of the body member 12 as shown by the gap G in FIG. 6.

Figure 7:
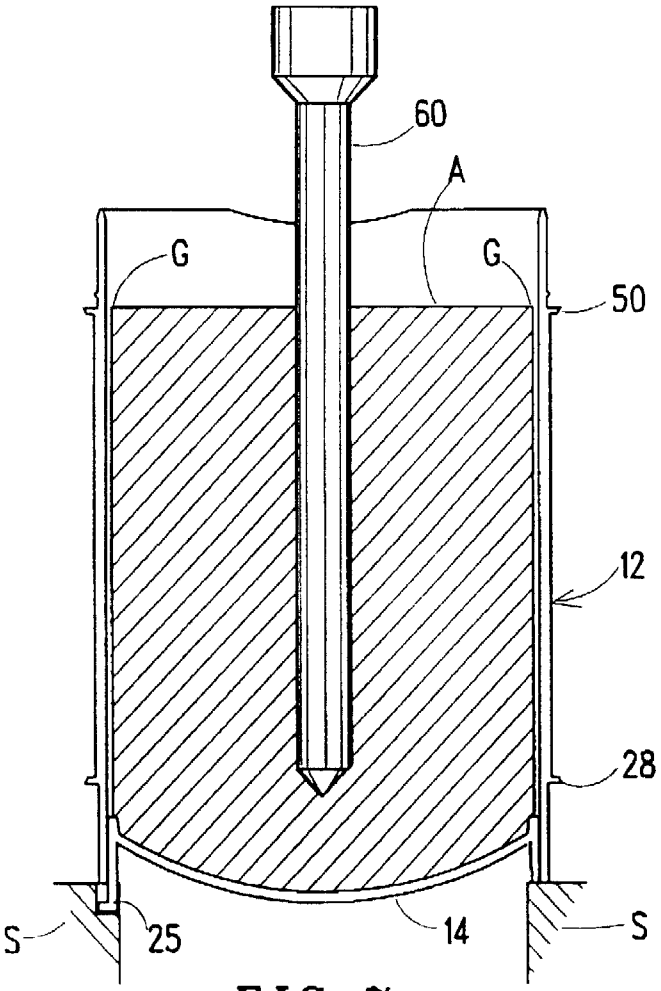
Figure 6:
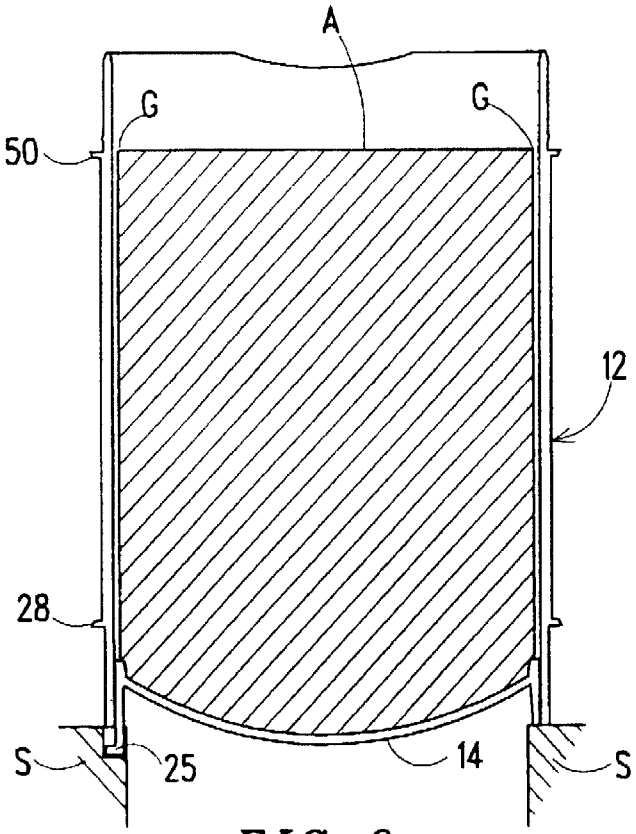
Figure 8:
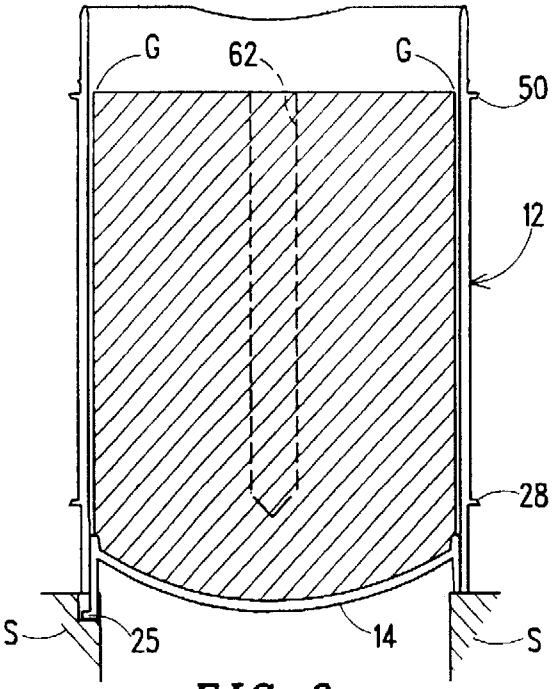

As best seen in FIGS. 7 and 8, with the assembly comprising the tubular body member 12 and the closure cap 14 still resting on the support structure S, an auger 60 having an outside diameter substantially the same as, or slightly larger than, the thread shaft 22 is inserted into the product A in non-molten form and then removed leaving a cylindrical opening 62 extending into the product A for receiving the shaft 22 in the finished product. While the auger 60 has been employed to form the cylindrical opening 62 in the product A, it should be understood that depending on the rigidity of the threaded shaft 22, the threaded shaft could be employed to form the opening, in which case the auger 60 would not be required in the process.

Figure 9:
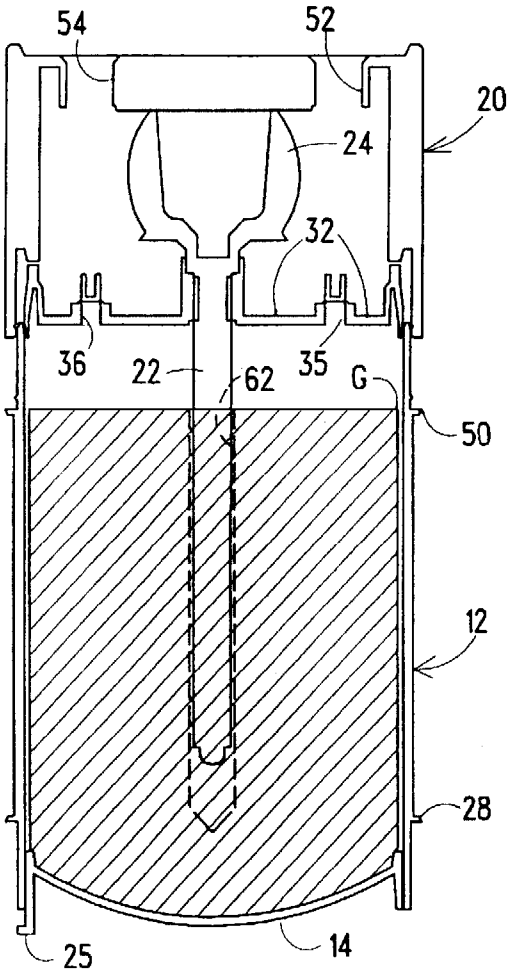
Figure 11:
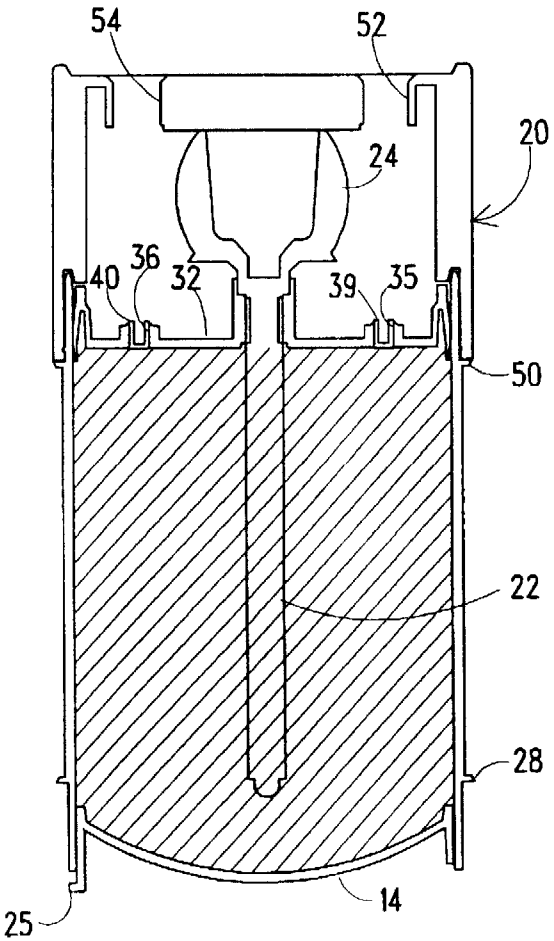
Figure 10:
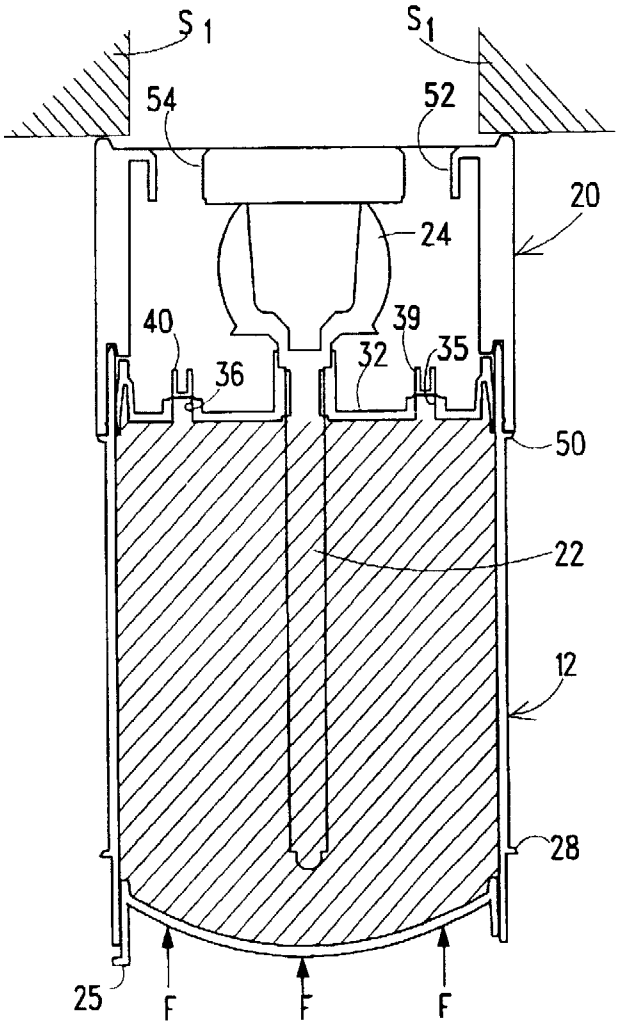

Referring now to FIGS. 9 through 11, and in particular FIG. 9, the seal member 16 assembled with the threaded shaft 22, ball 24 and bottom cover 20 are assembled onto the end of the body member 12 opposite the closure cap 14, the platform 32 substantially sealing off the end of the body member with the exception of the vent openings 35 and 36.

As shown in FIG. 10, with the assembly now supported at support S1, a force F is applied at the closure cap 14 to compress the product in non-molten form into the tubular member 12 with any air or gases escaping through the vents 35 and 36 as the closure cap 14 moves upwardly into the body member and the gap G is substantially eliminated, the product now adhering to the inner surface of the closure cap 14 and the tubular body member 12.

It should be understood that as an alternative, a support structure could be maintained at the closure cap 14 in which case the force F would be applied at the bottom cover 20 to produce a similar result.

As shown in FIG. 11, with the product at full contact with the interior surface of the tubular body member, the closure cap 14 and the platform 32, a tool (not shown) is generally inserted through the openings 52 and 54 to contact the plugs 39 and 40 and force them into the openings 35 and 36 to seal the product within the bounds of the closure cap, tubular body member, and platform.

While it should be understood that various materials may be processed by the described steps, the material of the product being processed in the present invention is a clear stick antiperspirant or deodorant such as that described in U.S. patent applications Ser. No. 08/397,450, filed Mar. 2, 1995, and Ser. No. 08/588,618, filed Feb. 6, 1996, both assigned to the assignee of the present invention.

While it is apparent that changes and modifications can be made within the spirit and scope of the present invention, it is our intention, however, only to be limited by the scope of the appended claims.

As our invention we claim:

1. A process for the manufacture of a cosmetic product in stick form which includes the steps of:

providing a container comprising a tubular body member having an opening at its upper end and an opening at its lower end;

providing a first seal means at one end thereof said seal means contacting the inner surface of said tubular body member in sliding engagement;

introducing a predetermined quantity of a cosmetic product at its molten temperature through the opposite end of said tubular body member;

cooling said cosmetic product to its non-molten form;

providing a second seal means in sliding engagement with said opposite end; and compressing the product in non-molten form by fixing one of said seal members and moving the other of said seal members toward said one seal member to force the cosmetic product in non-molten form into contact with the inner surface of said tubular member and said seal means by removing gaseous elements therefrom.

2. A process as set forth in claim 1 wherein said second seal means has vent means disposed therein for removing said gasses therethrough.

3. A process as set forth in claim 1 wherein said second seal means comprises a platform movable within said tubular body through rotation of a threaded shaft extending axially into said tubular member and includes the step of forming an elongated cavity in said product in non-molten form for receiving said threaded shaft prior to the step of compressing the product.

4. A process as set forth in claim 3 wherein said elongated cavity is formed by said threaded shaft.

5. A process as set forth in claim 2 which further includes the step of sealing said vent means after compressing the product in non-molten form.

6. A process as set forth in claim 1 wherein said molten temperature of said product is in the area of 65° C. to 850° C.

7. A process as set forth in claim 6 wherein said product is cooled to below 40° C. to produce the product in non-molten form prior to compressing the product.

8. A process as set forth in claim 3 which further includes the step of sealing said vent means after compressing the product in non-molten form.

9. A process as set forth in claim 8 wherein said second seal means comprises a platform movable within said tubular body through rotation of a threaded shaft extending axially into said tubular member and includes the step of forming an elongated cavity in said product in non-molten form for receiving said threaded shaft prior to the step of compressing the product.

10. A process as set forth in claim 9 wherein said elongated cavity is formed by said threaded shaft.

11. A process as set forth in claim 10 wherein said molten temperature of said product is in the area of 65° C. to 85° C.

12. A process as set forth in claim 11 wherein said product is cooled to below 40° C. to produce the product in non-molten form prior to compressing the product.

* * * * *